US012018904B2

(12) United States Patent
Berglund

(10) Patent No.: US 12,018,904 B2
(45) Date of Patent: Jun. 25, 2024

(54) MODULAR SOUND SUPPRESSING DEVICE FOR FIREARMS

(71) Applicant: Bruce Berglund, Centennial, CO (US)

(72) Inventor: Bruce Berglund, Centennial, CO (US)

( * ) Notice: Subject to any disclaimer, the term of this patent is extended or adjusted under 35 U.S.C. 154(b) by 147 days.

(21) Appl. No.: 17/511,663

(22) Filed: Oct. 27, 2021

(65) Prior Publication Data

US 2022/0221242 A1 Jul. 14, 2022

Related U.S. Application Data

(60) Provisional application No. 63/123,551, filed on Dec. 10, 2020.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.2, 14.4
See application file for complete search history.

(56) References Cited

U.S. PATENT DOCUMENTS

| | | | | |
|---|---|---|---|---|
| 4,576,083 | A * | 3/1986 | Seberger, Jr. | F01N 1/08 89/14.4 |
| 4,907,488 | A * | 3/1990 | Seberger | F41A 21/30 89/14.4 |
| 7,832,323 | B1 * | 11/2010 | Davies | F41A 21/34 89/14.4 |
| 8,973,481 | B2 * | 3/2015 | Dueck | F41A 21/30 89/14.4 |
| 9,933,224 | B2 * | 4/2018 | Dorne | F41A 21/30 |
| 10,222,162 | B2 * | 3/2019 | Adamson, Jr. | F41A 21/30 |
| 11,561,059 | B2 * | 1/2023 | Reis-Green | F41A 21/30 |

* cited by examiner

*Primary Examiner* — Dedei K Hammond
*Assistant Examiner* — Joseph James Peter Illicete
(74) *Attorney, Agent, or Firm* — Andrew Morabito

(57) ABSTRACT

A suppressor for firearms, comprising: a casing, comprising; a first end cap, an elongated hollow member, and an second end cap, an upstream disk secured in place between the first end cap and the elongated hollow member; a first hollow diffuser tube having a first end and a second end and a plurality of openings distal to the first end; a second hollow diffuser tube having a first end and a second end and a plurality of openings distal to the first end; and a downstream disk, wherein the disk has a centric opening.

19 Claims, 10 Drawing Sheets

MODULAR SOUND SUPPRESSING DEVICE FOR FIREARMS

CROSS-REFERENCE TO RELATED APPLICATIONS

This application is a continuation-in-part (and claims the benefit of priority under 35 USC 120) of U.S. application No. 63/123,551 filed Dec. 10, 2020. The disclosure of the prior applications is considered part of (and is incorporated by reference in) the disclosure of this application.

BACKGROUND

The present invention relates to a novel sound suppression device, and more particularly to reducing the acoustic intensity of the muzzle report.

Most suppressors/silencers are attached to the muzzle of a firearm and use a series of baffles inside a tubular outer shell to achieve reduced muzzle sound and flash. These designs attempt to use the baffles as a means to slow and allow to cool the hot discharge gasses and combustion products produced by the burning of propellants used in modern firearm cartridges. These gasses and combustion products leave the muzzle of a firearm at super-sonic speeds creating a shock wave and Mach disk that is the is the source of the loud report associated with firearm discharge. Unburned and partially burned propellants also exit the muzzle creating a flash of bright light that can be undesirable. The performance of this type of suppressor/silencer is only moderately successful, there still exists a high decibel sound and sometimes a flash still associated with this type of device. The use of baffles of many types (Q, S, P, OMNI) to name a few, are only partially successful in the reduction in sound and flash. Asymmetrical baffles can be more effective in the reduction of noise but have the undesirable effect of causing deviation in the path of the projectile leading to poor ballistic performance of the fired bullet.

Most silencers are caliber specific, meaning a separate Tax Stamp and silencer must be purchased for each caliber.

Most suppressors/silencers are attached to the muzzle of a firearm and use a series of baffles inside a tubular outer shell to achieve reduced muzzle sound and flash. These designs attempt to use baffles as a means to slow and allow to cool the hot discharge gasses and combustion products produced by the burning of propellants used in modern firearm cartridges. These gasses and combustion products leave the muzzle of a firearm at super-sonic speeds creating a shock wave and Mach disk that is the is the source of the loud report associated with firearm discharge. Unburned and partially burned propellants also exit the muzzle creating a flash of bright light that can be undesirable.

The performance of this type of suppressor/silencer is only moderately successful, there still exists a high decibel sound and sometimes a flash still associated with this type of device. The use of different types of baffles are only partially successful in the reduction in sound and flash.

Alternatively, asymmetrical baffles can be more effective in the reduction of noise but have the undesirable effect of causing deviation in the path of the projectile leading to poor ballistic performance of the fired bullet.

Therefore, a new design of firearm suppression is desired that further reduces the sound and flash than the previous devices.

BRIEF SUMMARY OF THE INVENTION

The present invention in a first embodiment is a suppressor for firearms, comprising: a casing, comprising; a first end cap, an elongated hollow member, and an second end cap, an upstream disk secured in place between the first end cap and the elongated hollow member; a first hollow diffuser tube having a first end and a second end and a plurality of openings distal to the first end; a second hollow diffuser tube having a first end and a second end and a plurality of openings distal to the first end; and a downstream disk, wherein the disk has a centric opening.

BRIEF DESCRIPTION OF THE DRAWINGS

An embodiment of the invention is illustrated as an example and is not limited by the accompanying drawings, in which like references may indicate similar elements and in which:

FIG. 11 depicts a section view of the assembled suppressor, wherein FIG. 9 is cut along plane 11, in accordance with one embodiment of the present invention.

DESCRIPTION OF THE DRAWINGS

Figure 1:
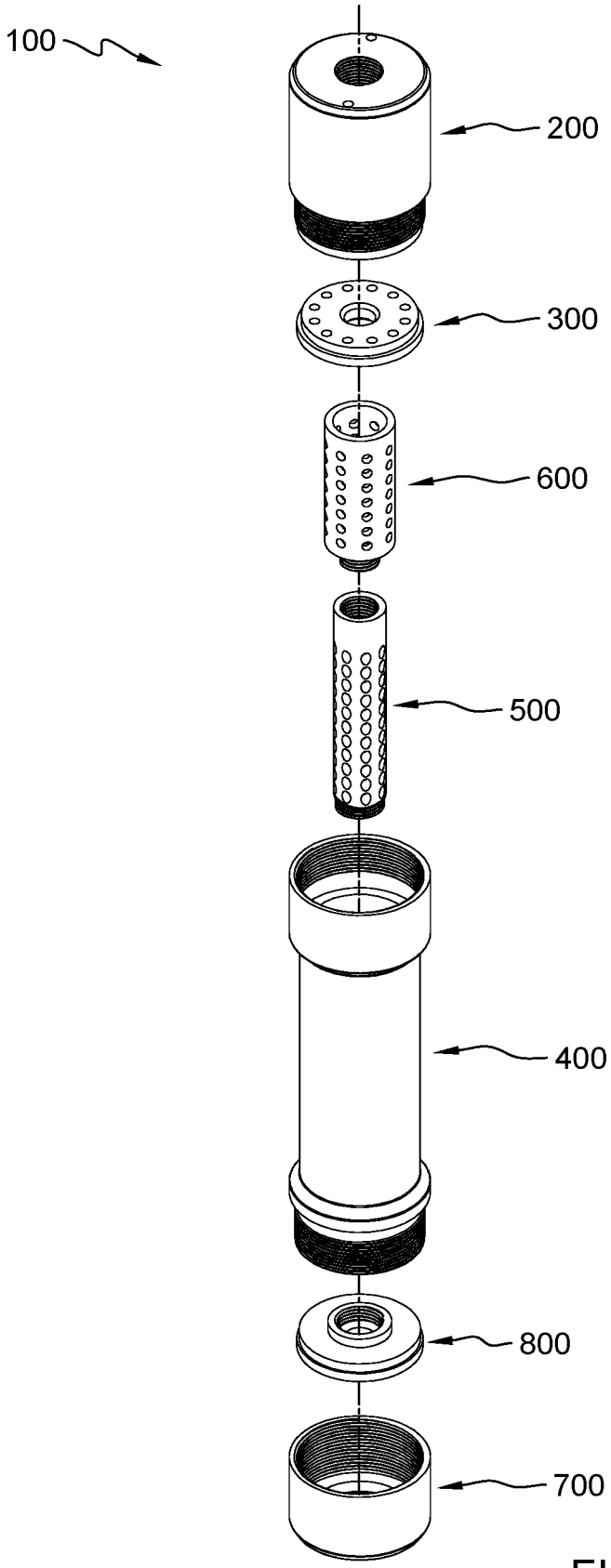
FIG. 1 depicts an exploded view of a suppressor, in accordance with one embodiment of the present invention.
Figure 2:
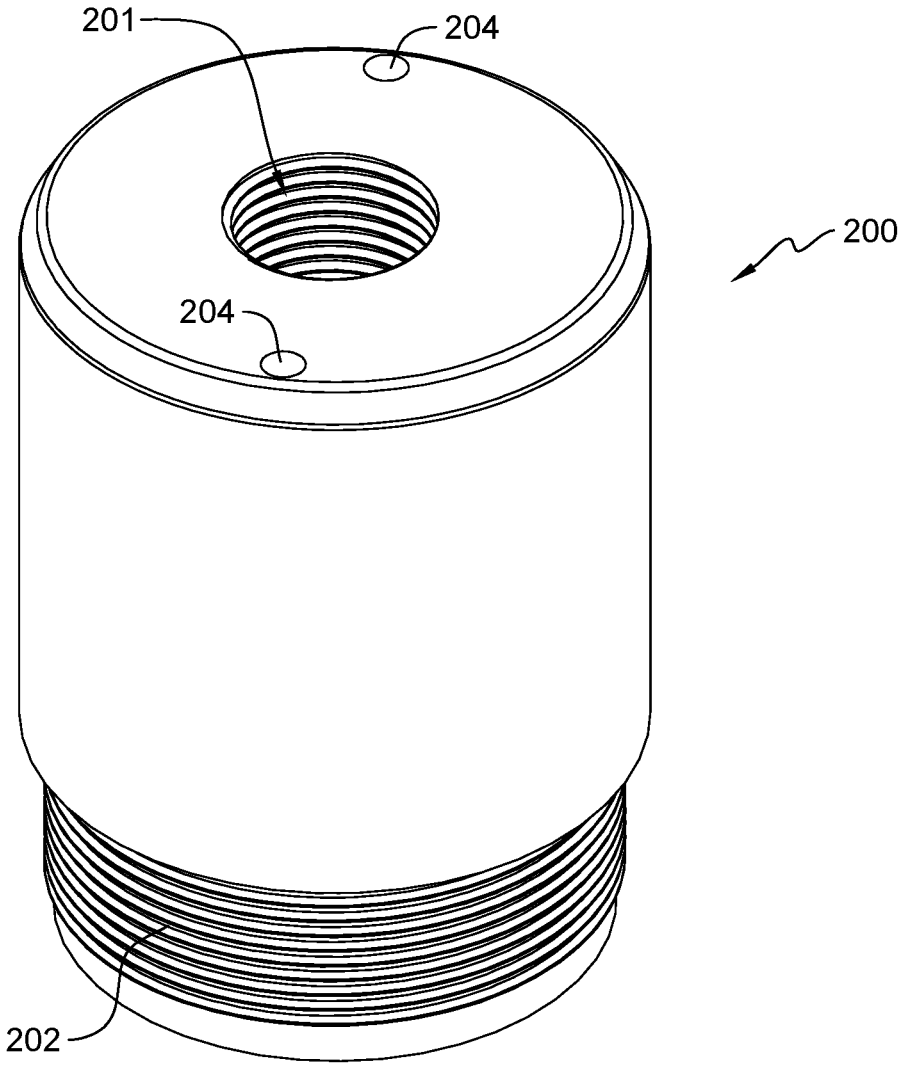
FIG. 2 depicts an isometric view of a barrel mount, in accordance with one embodiment of the present invention.
Figure 3A:
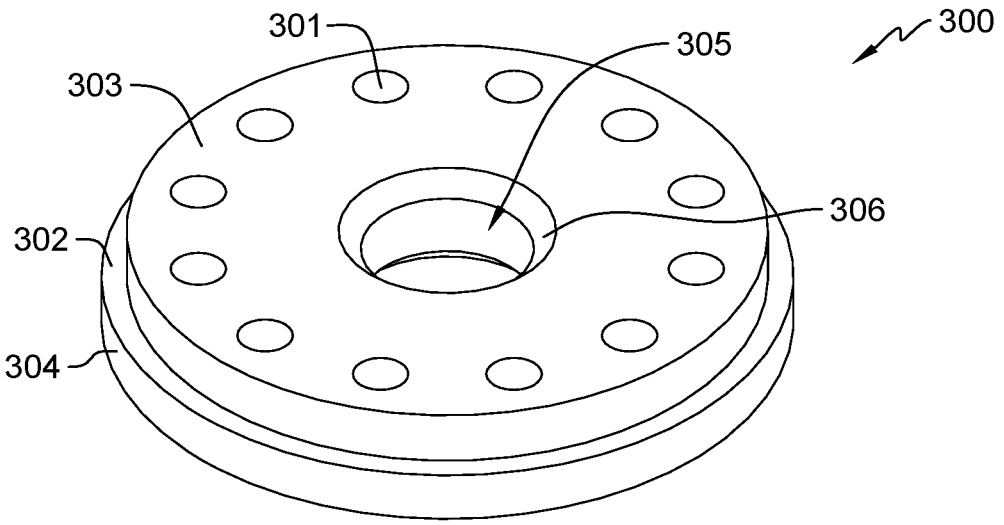
FIG. 3A depicts an isometric view of a diffusion disc, in accordance with one embodiment of the present invention.
Figure 3B:
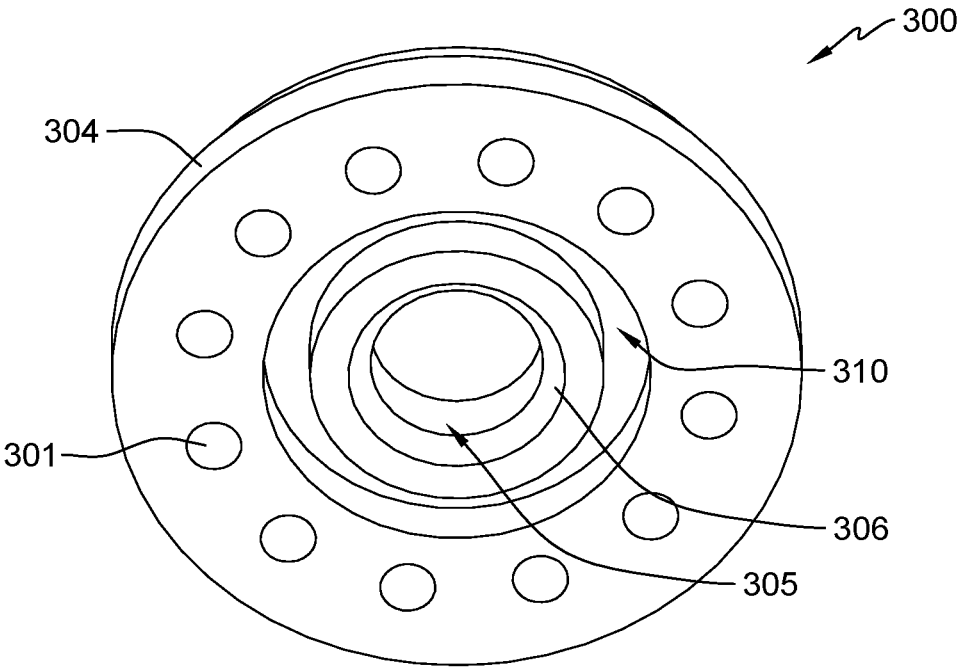
FIG. 3B depicts an isometric view of a diffusion disc, in accordance with one embodiment of the present invention.
Figure 4:
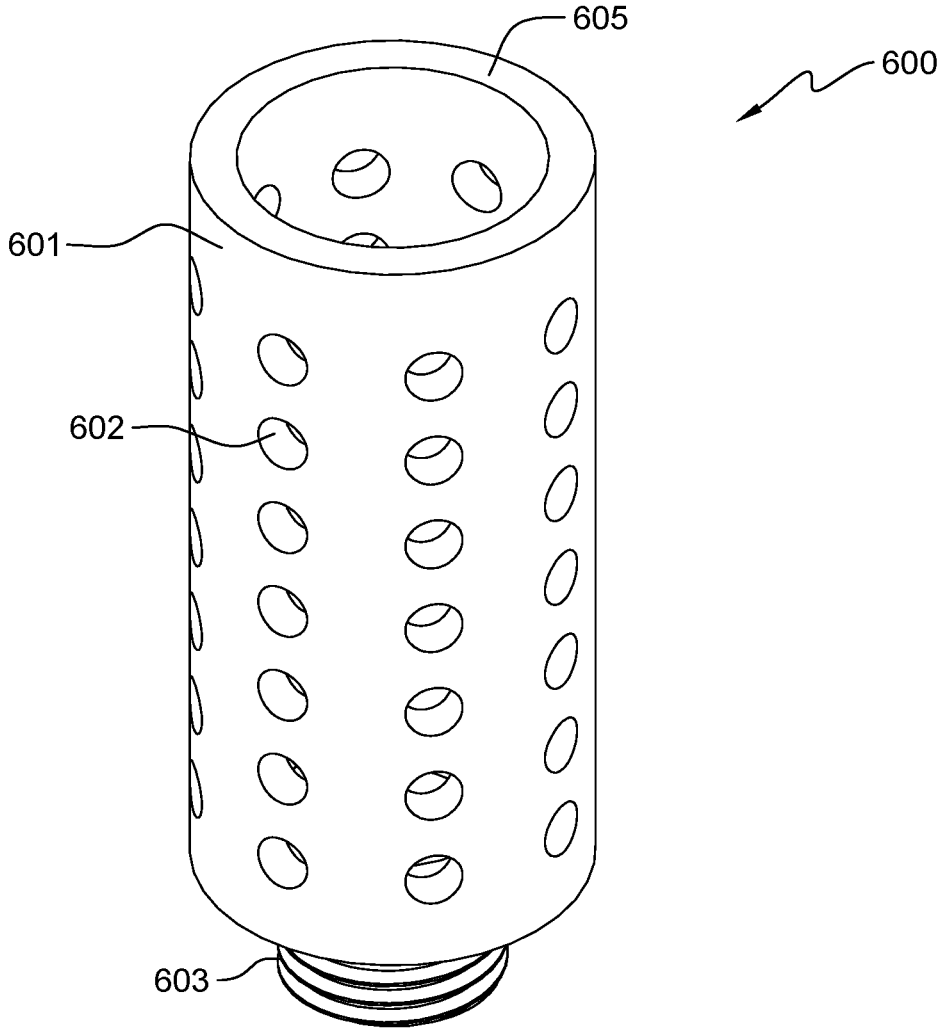
FIG. 4 depicts an isometric view of an upstream diffusion tube, in accordance with one embodiment of the present invention.
Figure 5:
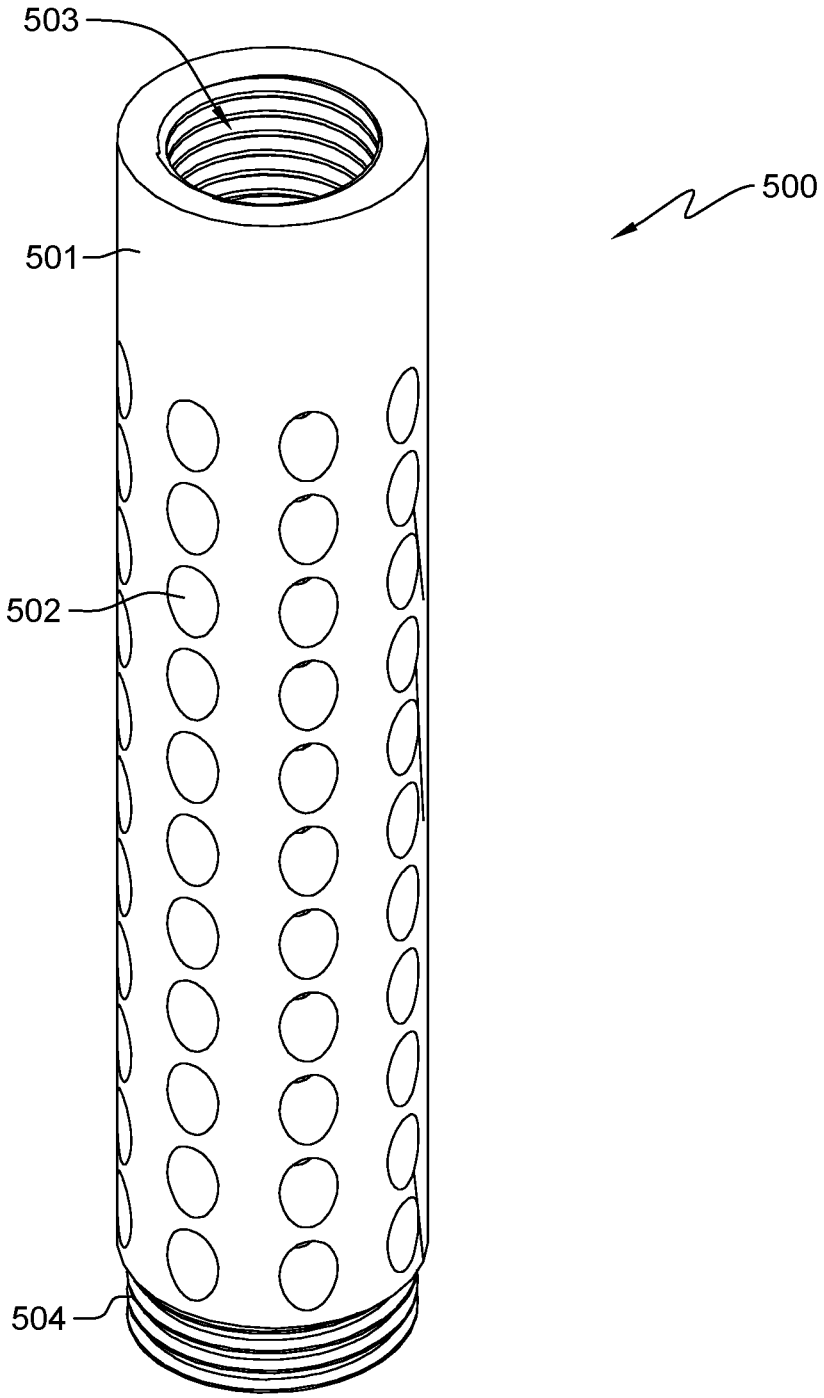
FIG. 5 depicts an isometric view of a downstream diffusion tube, in accordance with one embodiment of the present invention.
Figure 6:
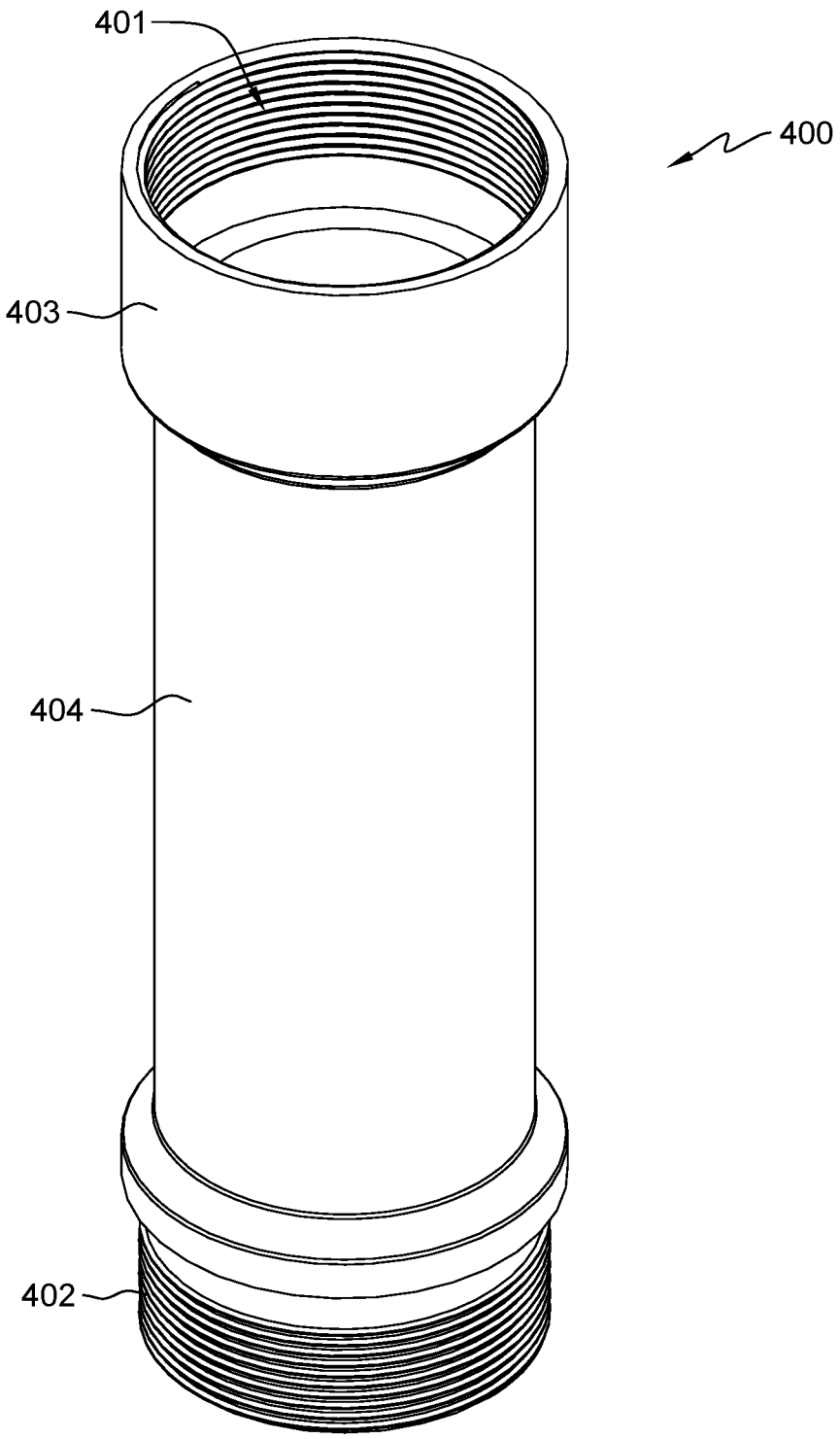
FIG. 6 depicts an isometric view of a tube, in accordance with one embodiment of the present invention.
Figure 7:
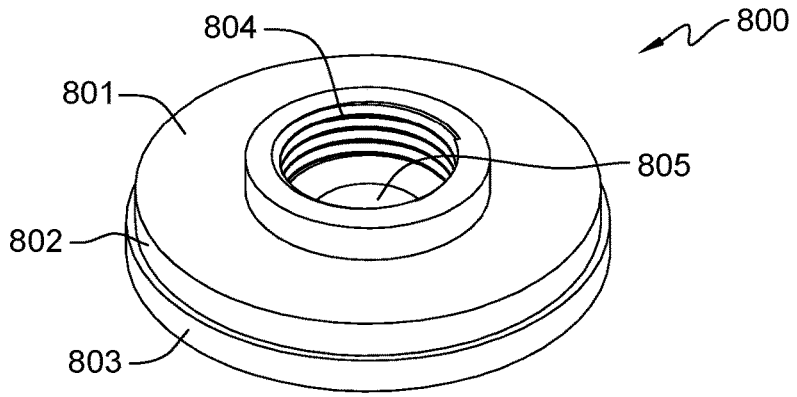
FIG. 7 depicts an isometric view of an end disc, in accordance with one embodiment of the present invention.
Figure 8A:
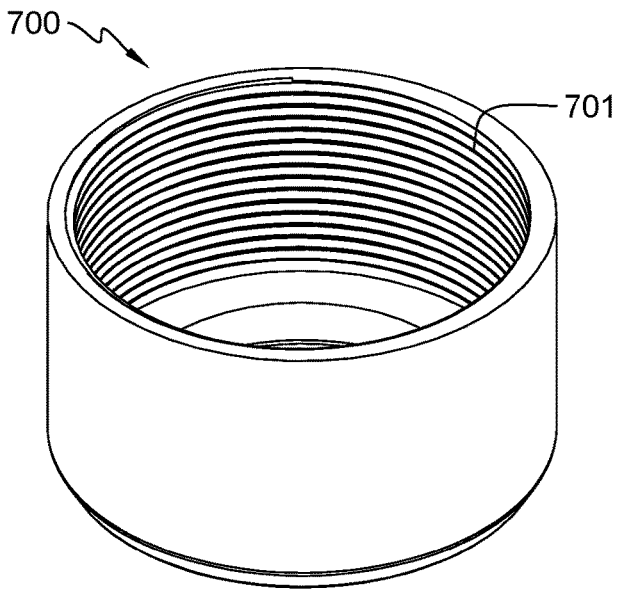
FIG. 8A depicts an isometric view of a retaining ring, in accordance with one embodiment of the present invention.
Figure 8B:
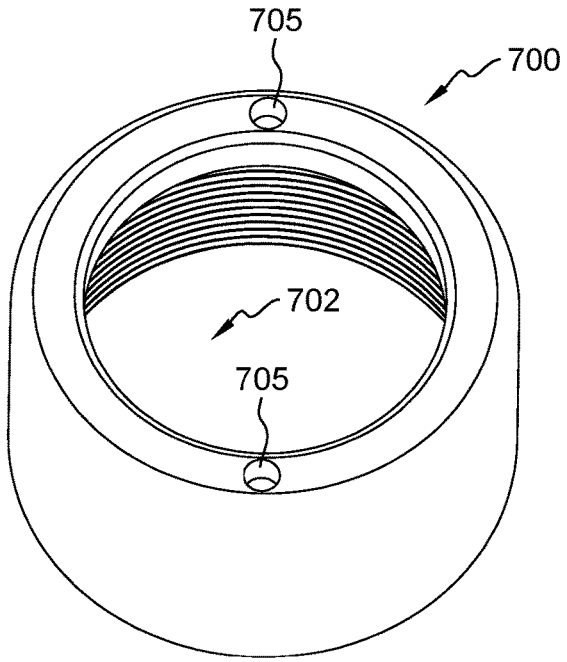
FIG. 8B depicts an isometric view of a retaining ring, in accordance with one embodiment of the present invention.

The present invention provides a suppressor that further improves the ability to reduce the sound and muzzle blast of firearms. The advantage of the present invention it is much quieter. it does not require hearing protection when using a firearm. According to Occupational Safety and Health Administration (OSHA) guidelines sound above 140 decibel (dB) is injurious to hearing. this device greatly reduces the dB levels allowing a shooter to no longer need hearing protection to avoid hearing damage the invention can be used with various firearms from handguns to rifles. This provides an improved silencer/suppressor for numerous firearms.

The products of the present invention provide a suppressor that further improves the ability to reduce the sound and muzzle blast of firearms and allow its use on multiple calibers of firearm. The advantage of the present invention is it is much quieter. It does not require hearing protection when using a firearm. According to Occupational Safety and Health Administration (OSHA) guidelines sound above 140 decibel (dB) is injurious to hearing. this device greatly reduces the dB levels allowing a shooter to no longer need hearing protection to avoid hearing damage the invention can be used with various firearms from handguns to rifles. The ability to use this device on multiple calibers of firearm greatly reduces the costs associated with suppressing multiple firearms. This provides an improved silencer/suppressor for numerous firearms.

The advantage of the invention is its quietness, superior flash suppression and the ability to use this suppressor on multiple calibers compared to other designs. Other suppressor designs are based on the use of various types of baffles, this has not changed in over 100 years. this new suppressor design does away with the baffles and achieves a superior effect with the use of the central passage, with apertures or ports to slow and cool gasses and other products of a modern firearm cartridge, therefore sound and flash reduction are greatly improved.

The suppressor is designed to work with a variety of different firearms of various calibers, there are currently on the market so called multi caliber suppressors, they are, in general, suppressors with a large enough central passage to accommodate the largest caliber they are rated for. This approach has a poor reduction of sound and flash with smaller calibers, due to the large central passage. This novel design addresses this shortcoming by having three interior parts that can easily be replaced. The diffuser disc, the upstream diffuser tube, and the end disc are supplied with this system in three different diameters of the central passage to more closely match the caliber being fired, thus achieving better sound and flash reduction. The ability of this design to be used on multiple calibers of firearm greatly reduces the costs associated with suppressing the many calibers of firearms owned by many shooters.

The advantage of the invention is its quietness, superior flash suppression, and the ability to work with a variety of calibers. Other suppressor designs are based on the use of various types of baffles, this has not changed in over 100 years. this new suppressor design does away with the baffles and achieves a superior effect with the use of the central passage, with holes or ports and the screen or ribbon to slow and cool gasses and other products of a modem firearm cartridge, therefore sound and flash reduction are greatly improved over previous designs.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein may also be used in the practice or testing of the present invention, the preferred methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

The terminology used herein is for the purpose of describing particular embodiments only and is not intended to be limiting of the invention. As used herein, the term "and/or" includes any and all combinations of one or more of associated listed items. As used herein, the singular forms, "a" "an", and "the" are intended to include the plural forms as well as the singular forms, unless the context clearly indicates otherwise. It will be further understood that the terms "comprises" and or "comprising" when used in this specification, specifically the presence of stated features, steps, operations, elements, and or components, but do not preclude the presence or addition of one or more other features, steps, operations, elements, components, and or groups thereof.

Unless otherwise defined, all terms used herein have the same meaning as commonly used and understood by one having ordinary skill in the art to which to which this invention belongs. It will be further understood that terms, such as those defined in commonly used dictionaries, should be interpreted as having a meaning that is consistent with their meaning in the context of the relevant art.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from every possible combination of the parts of the individual invention. Nevertheless, the specifications and claims should be read with the understanding that such combinations are entirely within the scope of the invention and claims.

In the following description, for the purpose of explanation, numerous specific details are set forth to provide a thorough understanding of this invention.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein may also be used in the practice or testing of the present invention, the preferred methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

For the purpose of clarity, the following descriptions are used. Upstream shall be understood to indicate the direction from which a projectile comes from. Downstream shall be understood to indicate the opposite direction.

The present disclosure is to be considered as an exemplification of the invention and is not intended to limit the invention to the specific embodiments of the figures or description below.

The Figures depict various images of the suppressor 100, in accordance with one embodiment of the present invention. The suppressor 100 is comprised of a barrel mount 200, a tube 400, a retaining ring 700, a diffuser disc 300, an end disc 800, a diffuser core assembly (comprised of an upstream diffuser tube 600 and a downstream diffuser tube 500). The suppressor 100 components are able to be separated into its components for cleaning and for ease of replacement of parts.

Barrel mount 200 attaches to the muzzle of a firearm by means of the threaded opening 201. In additional embodiments the threaded opening 201 may be replaced by other means to secure the suppressor 100 to the fireman based on the type of firearm. At the opposite end of the barrel mount 200 is a threaded portion 202 which is used to secure the barrel mount 200 to the tube 400. The tube 400 has a first end with a threaded female opening 401 and a second end with a threaded male 402 extension. The opening 401 is designed to mate with the threaded portion 202 of the barrel mount 200, and the threaded extension 402 is designed to mate with the opening 702 of the retaining ring 700. The tube 400 has a top end 403 which is designed to fit the diffuser disc 300 in place and an extended middle portion 404 to fit the diffuser core assembly. The retaining ring 700 is designed to secure to the threaded extension 402 of the tube 400 and has an opening 702 for the projectile to exit the suppressor 100. These three parts form the exterior body of the suppressor 100.

The suppressor is connected to the firearm at the barrel mount 200, showing the (upstream) end which attaches to the muzzle of a firearm by threads or other means. The barrel mount 200 has a threaded opening 201, that can be used to attach the suppressor to the muzzle of a firearm. Also visible are the two apertures 204, in the outer edge of the barrel mount 200, that are to be used with a spanner type wrench to firmly assemble the suppressor. The (upstream) end or edge of the barrel mount 200, is beveled to relieve a sharp edge. Internally the barrel mount 200 has a cavity 205. At an opposite end of the threaded opening 201 is a portion of the barrel mount 200 which is threaded 202. The barrel mount 200, is formed with an opening 201 with threads at the (upstream) end of the part, in the center, to attach to the muzzle of a firearm. The barrel mount 200 is formed with threads 202 at the (downstream), outside, end to attach to a threaded end 401 of the tube 400.

Contained within the exterior body of the suppressor 100 is the diffuser disc 300, the end disc 800, a diffuser core assembly (comprised of an upstream diffuser tube 600 and a downstream diffuser tube 500). The diffuser disc 300 is secured between the barrel mount 200 and the tube 400. The diffuser core assembly comprises a downstream diffuser tube 500, an upstream diffuser tube 600. The downstream diffuser tube 500 is secured to the upstream diffuser tube 600 at one end and is secured to the end disc 800 at the other one end. The upstream diffuser tube 600 is inserted into a groove 310 of the diffuser disc 300 at the end which is not secured to the downstream diffuser tube 500. The diffuser disc 300 is secured between the tube 400 and the barrel mount 200. The downstream diffuser tube 500 is secured to the end disc 800. When fully assembled a substantially straight channel is formed from the barrel mount 200 to the retaining ring 700 so a projectile is able to enter and exit the suppressor 100 without coming in contact with any part of the suppressor 100 and with minimal effect on the rotation, speed, and trajectory of the projectile. Within the tube and the barrel mount 200 are space which is designed for the gasses and high energy by products of the projectile to expand into.

Barrel mount 200 has a lip 203 along the threaded end which is designed to receive the diffuser disc 300 and secures the diffuser disc 300 in place between the barrel mount 200 and the tube 400. The diffuser disc 300 has a plurality of apertures 301 to allow for the passage of gases and by products of the cartridge. The aperture 305 has a counter sink 306 design on both sides of the diffuser disc 300. A central aperture 305 is designed to allow passage of the projectile. The diffuser disc 300 has an upper portion 303 and a lower portion 304 where a surface 302 is formed which comes in contact with the lip 203 of the barrel mount 200.

The downstream diffuser tube 500 is a perforated tube that allow gasses and other high energy products of the combustion of the propellant in the cartridge to be directed into the cavity 105 of the tube 400. The apertures 502 are of a predetermined size, positioning, and pattern. These expanded and cooled gasses and other high energy products of the combustion of the projectile, meet the gasses that flowed through the apertures. The downstream diffuser tube 500 has a threaded end 503 which connects with a threaded opening 603 of the upstream diffuser tube 600. The opposing end of the downstream diffuser tube 500 is threaded 504 to connect with the end disc 800.

The upstream diffuser tube 600 is a perforated tube 601 that allow gasses and other high energy products of the combustion of the propellant in the projectile to be directed into the space formed between the upstream diffuser tube 600 and the tube 400 and allows the projectile to exit the suppressor 100. The apertures 602 are of a predetermined size, positioning, and pattern. The upstream diffuser tube 600 has a threaded end 603 which connects with a threaded opening of the downstream diffuser tube 503 and has a smooth end 605 which fits within the groove 310 of the diffuser disc 300.

The end disc 800 has a threaded opening 804 designed to receive the downstream diffuser tube 504. The end disc 800 has a central opening 805. The end disc 800 has an upper portion 801 and a lower portion 803 which form a lip 802. The upper portion 801 and the lower portion 803 are sized differently to create the lip 802 which is used to secure the diffuser disc 800 between the retaining ring 700 and the tube 400

The retaining ring 700 has a central opening 702 and a threaded portion 701 to secure to the tube 400.

Figure 9:
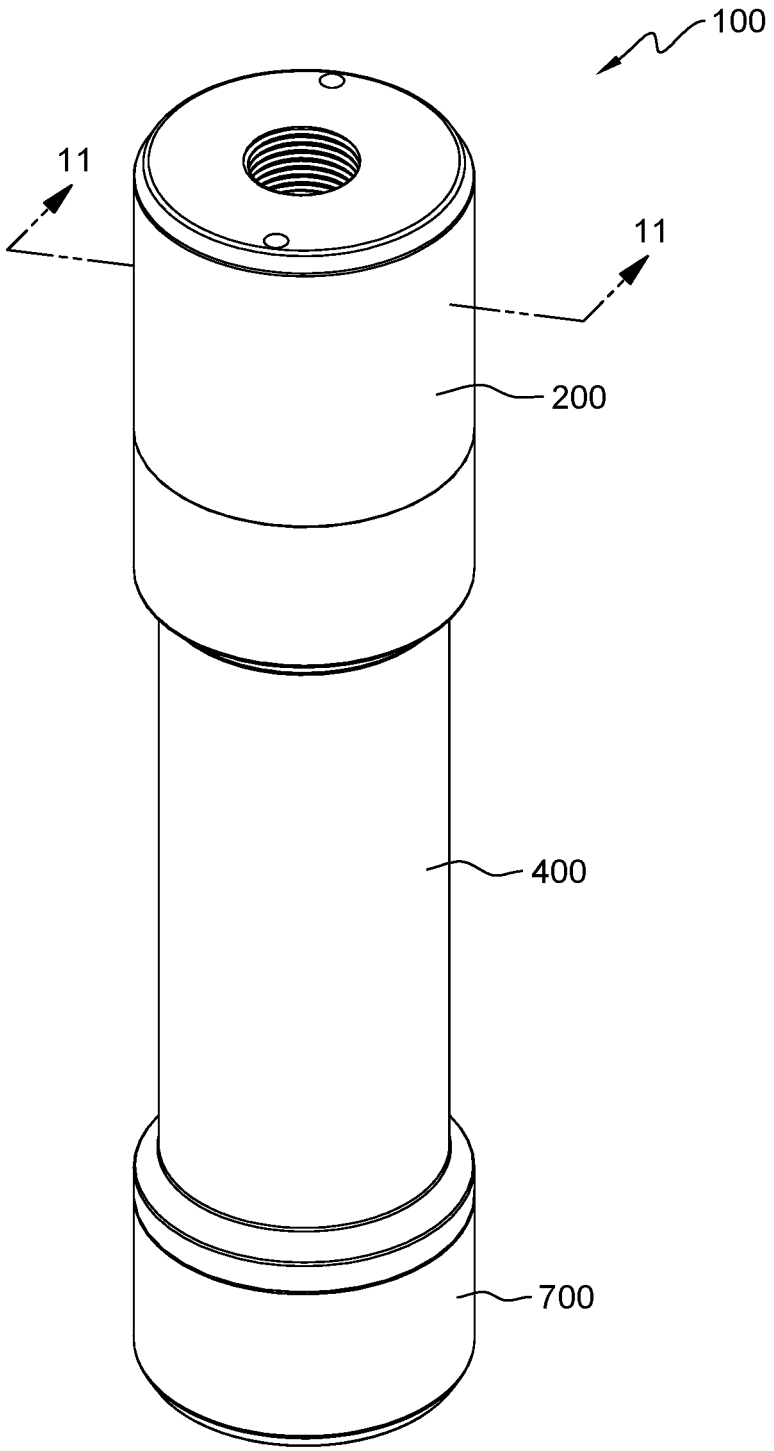
FIG. 9 depicts an isometric view of an assembled suppressor, in accordance with one embodiment of the present invention.
Figure 10:
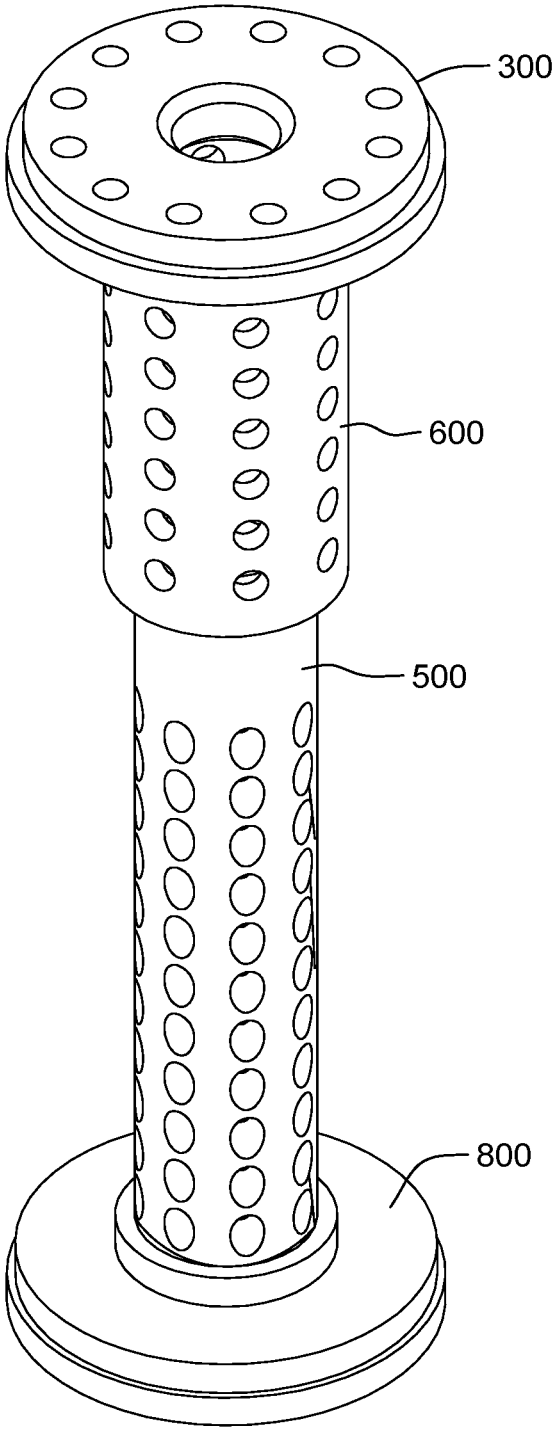
FIG. 10 depicts an isometric view of the internal components assembled, in accordance with one embodiment of the present invention.
Figure 11:
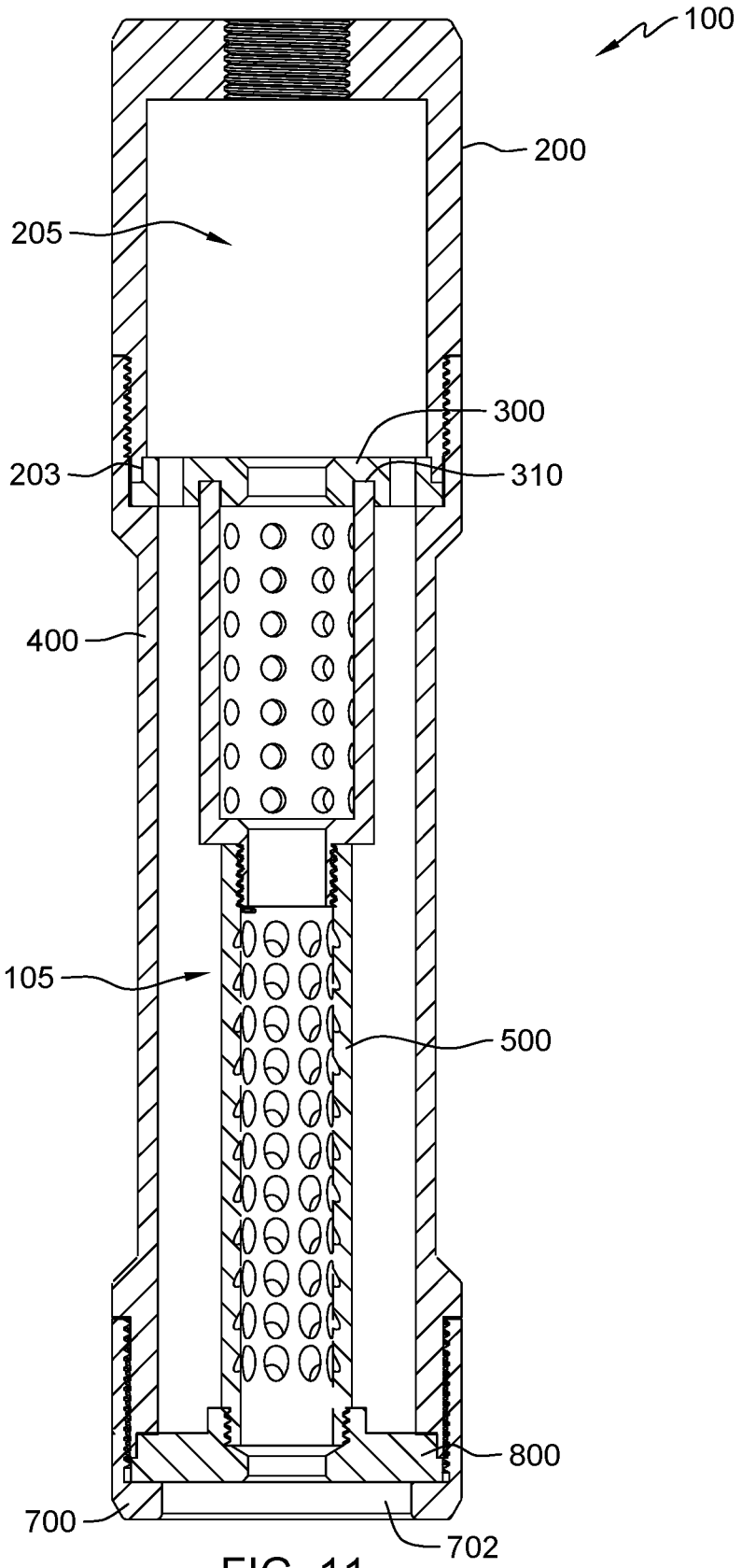

The gasses and other high energy products are forced to slow and cool as they expand and pass from the muzzle of the firearm into the chambers, which are formed inside the suppressor 100, which are shown in FIG. 11 which is cut along plane 11 shown in FIG. 9. These chambers are designed so that gasses flow from the inner channel into the space within the suppressor 100.

The gasses and other high energy products are forced to slow and cool as they expand and pass into the chamber formed inside the second section.

The barrel mount 200 and the tube 400 are secured together, with the diffuser disc 300 compressed between these two elements. The barrel mount 200 and the diffuser disc 300 have substantially similar profiles, so that the two parts securely come in contact with one another along their edges. When the diffuser disc 300 is positioned within the tube 400 and the barrel mount 200 is secured to the tube, the diffuser disc 300 securely fits between the barrel mount and the tube so that there is little to no movement of the diffuser disc 300. This forms cavity 205 within the barrel mount 200. The cavity, 205, which is formed by the walls of the barrel mount 200 and terminated by the diffuser disc 300, where the gasses and other high energy products generated by a particular cartridge used by the firearm exit the muzzle of the firearm. These gasses and other high energy products exit the muzzle of a firearm at super-sonic speeds, at high pressure and high temperature. This cavity 205 inside the barrel mount 200 of the suppressor allows the gasses and other high energy products generated by a particular cartridge used by the firearm to slow and cool as they enter this cavity by allowing expansion into the cavity, 205.

The gases that exit cavity 205, exit through openings 301 or aperture 305 of the diffuser disc 300. The diffuser disc 300 is formed so that at its center an aperture 305 is formed, that allows the passage of the fired projectile. Both the (upstream) and (downstream) edges 306 of this aperture 305 are beveled, to avoid disturbing the path of the projectile. In some embodiments, the aperture 305 is not beveled or has one side which is beveled. The diffuser disc 300 has a groove 310 with a predetermined depth and width, and openings 301 which extend completely through the diffuser disc 300. These cooled and slowed gasses and other high energy products exit the cavity 205 through the central aperture in the diffuser disc 300, and through a plurality of openings 301. Formed in a circular fashion in the diffuser disc 300, these openings 301 allow portions of gasses and other high energy products produced by a modern cartridge that do not go through the central aperture in the disc, to slow and cool further as they enter the space 105 inside the tube 400 of the exterior of the suppressor. Passing through these openings 301, slows and cools these gasses and other high energy products. This disc is formed with a "stepped" edge, this allows the smaller diameter to fit the open end of the barrel mount 200. The inside of the barrel mount 200 is formed to accept the diffuser disc 300.

The upstream diffuser tube 600 is sized to fit within the groove 310 of the diffuser disc 300 to secure the upstream diffuser tube 600 in place. The majority of the upstream diffuser tube 600 has a series of openings 602. The portion of gasses and other high energy products exit the chamber 205 formed in the barrel mount 200, and the other portion of gasses and other high energy products exiting through the plurality of apertures 602 formed in the upstream diffuser tube 600. The internal diameter and external diameter of the upstream diffuser tube 600 are larger than that of the downstream diffuser tube 500 to create a larger space (but smaller than cavity 205) for the gases to expand behind the projectile. The thickness of the upstream and downstream diffuser tubes is based on the material strength to be able to handle the forces exerted on them and to withstand the heat produced by the ignition of the cartridge. The downstream and upstream diffuser tubes, have a predetermined wall thickness and are robust enough in construction to contain the initial ejection of gasses and other products produced by the firing of a modern firearms cartridge.

The downstream diffuser tube 500 is a hollow tube 501. The openings 502 may be substantially the same diameter as shown in the depicted embodiment. In additional embodiments, the openings 502 may be of various diameters and formed in different angles. The openings 502, allow the energetic products of cartridge ignition to flow into and out of the interior cavity of the downstream diffuser tube 500. The outflow of these gases and other high energy products of cartridge ignition is facilitated by the constriction of the central passage at the end disc 800. The gasses and other high energy products produced by the ignition of the cartridge are slowed and cooled by their passage through the openings 502. The openings 502 are positioned in a predetermined way to maximize the number of openings while also providing enough structural rigidity.

A large portion of gasses and other high energy products exit through the plurality of apertures 502 and 602 into the interior space 105. In the depicted embodiments, the openings 602 and 502 are positioned in rows and of substantially similar diameters. In various embodiments the positioning of the openings 502 and 602 may be adjusted and the size of the openings 502 and 602 may be adjusted. In additional embodiments, the openings 502 and 602, may be in an alternating pattern or alternating sizes and angles.

The upstream diffuser tube 600 is designed to mate with the downstream diffuser tube 500 and be inserted into the diffuser disc 300 groove 310 so that all interior parts align within the suppressor. The upstream diffuser tube 600 is inserted into the groove 310 of the diffuser disc 300. The silencer 100 is designed so it can be easily assembled and disassembled and have parts replaced when necessary. The upstream diffuser tube 600 has a plurality of apertures 602 displaced along the tube, but with proper distancing from the threaded end and the open end. Gasses and other high energy products which pass through the upstream diffuser tube 600 are further expelled through these apertures 602. A large portion of gasses and other high energy products exiting through the plurality of apertures 602 of the upstream diffuser tube 600. The apertures 602 are sized, angled, and positioned, based on the quantity of gasses and high energy products which are created when a bullet is fired. The upstream diffuser tubes 600 has a predetermined diameter, length, apertures sizes, and the like. The upstream diffuser tube 600, has a tubular structure. The portion of gasses and other high energy products that exit the upstream diffuser tube 600, through the apertures 602 will enter the interior cavity 105 where they continue to cool and expand.

The downstream diffuser tube 500 is designed to mate with the upstream diffuser tube 600 and mates with the end disc 800 so that all interior parts align within the suppressor. The downstream diffuser tube 500 has a plurality of apertures 502. These apertures 502 are positioned to not interfere with the threaded ends. Gasses and other high energy products which pass through the downstream diffuser tube 500 are further expelled through these apertures 502. A large portion of gasses and other high energy products exiting through the plurality of apertures 502 along the side of the downstream diffuser tube 500. The apertures 502 are sized, angled, and positioned, based on a quantity of gasses and high energy products which are created when a bullet is fired. The downstream diffuser tube 500 has a predetermined diameter, length, apertures sizes, and the like. The downstream diffuser tube 500, has a tubular structure. The portion of gasses and other high energy products that exit the downstream diffuser tube 500, through the apertures 502 will enter the interior cavity 105 where they continue to cool and expand. The downstream diffuser tube 500 is of a smaller interior and exterior diameter than the upstream diffusor tube 600 allowing a larger space to be enclosed by the tube 400 promoting the further expansion and cooling of the gasses and other high energy products produced by the ignition of a modern cartridge. In some embodiments, the diameter of the upstream diffuser tube 600 and the downstream diffuser tube 500 are proportionate based on the weapon and the caliber. In the depicted embodiment the upstream diffuser tube 600 has a larger interior diameter than the downstream diffuser tube 500. In other embodiments, the diameters may be the same, or the downstream diffuser tube 500 may be larger than the upstream diffuser tube 600.

The gasses and other high energy products produced by the ignition of the cartridge are slowed and cooled by their passage through the openings, apertures or ports 602 and 502. The openings 602 and 502, are positioned in a predetermined way to maximize the number of openings while also providing enough structural rigidity. In the depicted embodiment, the openings 602 and 502, are positioned in substantially straight rows and columns. In some embodiments, these openings 602 and 502 are formed at a 45-degree angle towards the (downstream) end of the suppressor to direct the gases into the cavity 105. In additional embodiments, the openings 602 and 502, may be in various patterns, sizes (diameters), shapes, angles, and the like. In some embodiments, the openings 602 and 502 each opening can be a different size.

The retaining ring 700 holds the end disc 800, inside the (downstream) end of the tube 400 of the suppressor. The retaining ring 700 has a threaded interior surface 701, and an opening 702. The end disc 800 "stepped" portion 803 is compressed between the retaining ring 700 "shoulder" and the tube 400. When the tube 400 is secured to the retaining ring, the end disc 800 is secured in place and assists in aligning the upstream and downstream diffuser tubes 500 and 600. The end disc 800 has a threaded opening 804. The end disc 800 attaches to the downstream diffuser 500 and are aligned in the center of the suppressor.

In some embodiments, opening 805 of the end disc 800 is beveled to relieve the sharp edge.

The end cap 700 has a plurality of openings 705 for use with a spanner type wrench to be used to tighten the threads of the assembly.

When constructed, the upstream and downstream diffuser tubes 500 and 600 are secured within the tube 400, and between the end disc 800 and the diffuser disc 300 respectively. The tube 400 and the retaining ring 700 secure the end disc 800 and the upstream end of the upstream diffuser tube 600 is firmly secured in the groove 310 of the diffuser disc 300. With the components assembled an interior cavity 105 is formed.

The interior cavity 105 which is formed within the tube 400, provides an increased volume for the gasses to expand before needing to exit the suppressor. The upstream diffuser tube 600 is of a larger interior and exterior diameter than the downstream diffuser tube 500 tube allowing for more expansion and cooling of the gasses and other high energy products produced by the ignition of a modern cartridge.

The tube 400 extends from the barrel mount 200 to the retaining ring 700, at the outer (downstream) end of the suppressor and forms cavity 105. These three parts are joined in a linear fashion by having mating threaded portions on the parts. For example, the male threads formed on the (downstream) end of the barrel mount 200, mating with the female threads formed on the inside (upstream) end of the tube 400 and the (downstream) male threads formed on the outside of the tube 400, mating with the female threads formed on the inside of the retaining ring 700.

The end disc 800 is secured between the retaining ring 700 and the tube 400 when they are secured together. The (downstream) end of the tube 400 is terminated in this assembly by the end disc 800, the first "stepped" portion of this disc fits inside the circular opening formed to accept this "stepped" portion of the end disc 800 in the (downstream) end of the tube 400. The second "step" matches the diameter of the threaded (downstream) end of the tube 400. This allows the end disc 800 to be held firmly in place between the retaining ring 700 and the tube 400

At the (downstream) end of the diffuser disc 300, the interior diameter of the tube 400, a "shoulder", is formed with a smaller diameter then the diameter of the larger stepped portion of diffuser disc 300. When the (upstream) female threads on the tube 400 and the (downstream) male threads on the barrel mount 200 are tightened, the diffuser disc 300 is compressed. This, along with the tightening of the tube 400 and the barrel mount 200, forces the alignment of the diffuser disc 300, providing a straight and clear path for the projectile to pass through all parts of the suppressor without striking any portion of this assembly.

The cavity 105 formed within the tube 400 between the interior surface of the tube 400 and the exterior surfaces of the upstream and downstream diffuser tubes 600 and 700. This cavity 105 provides for space for the gasses and other high energy products of the ignition of a modern cartridge from inside the central diffuser tube and the portion that passed through the plurality of apertures in the diffuser disc 300, mix, combine and interfere with each other. This allows the gasses and other high energy products to further slow and cool. The gasses and other high energy products then exit through the openings 602 and 502 and finally exit the suppressor through the opening 805 in the end disc 800.

The suppressor 100 is designed to work with a variety of firearms with a variety of different calibers. The threaded opening 201 of the barrel mount 200 is able to be various sizes and designs to accommodate different firearms and different calibers. The upstream and downstream diffuser tubes 500 and 600 may also have varying interior diameters and lengths to accommodate different calibers, as well as the diffuser disc 300, end disc 800, or the retaining ring 700. The tube 400 may be of varying sizes and diameters based on the firearm and different calibers to be able to accommodate the energy, heat, gases, and the like which are produced by the different cartridge sizes. The key advantage of this design is the ability to design each component for various firearms and calibers and allow the user to replace specific components when changing between firearms and calibers and not have to purchase an entirely new suppressor. They can just replace the specific component that needs to be changed out. For example, the barrel mount 200 can be swapped to be used on two different firearms with the same caliber but have different barrels. One barrel may be metric, and the other barrel may be UNC/UNF but have the same or comparable calibers. In some embodiments, the barrel mount 200 may have an additional adapter or the like made to attached to the threaded end of the barrel mount 200 so that the suppressor can be used with various firearms without having to replace the barrel mount 200.

The threaded portions of the components may have various thread counts and types. Including but not limited to unified national coarse (UNC), metric, or other types known to someone skilled in the arts.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

The invention claimed is:

1. A suppressor for firearms, comprising:

an upstream disk, having a first portion with a first diameter and a second portion with a second diameter wherein the disk has a centric opening and a groove on a first surface and a plurality of openings positioned around the centric opening;

a first hollow diffuser tube having a first end and a second end and a plurality of openings distal to the first end, wherein the second end is threaded, and the first end is fitted into the groove of the upstream disk;

a second hollow diffuser tube having a first end and a second end and a plurality of openings distal to the first end, wherein the first end interior surface is threaded and interfaces with the second end of the first hollow diffuser, and an exterior surface of the second end of the second hollow diffuser tube is threaded;

a downstream disk, wherein the disk has a centric opening that is threaded to mate with the second end of the second hollow diffuser tube and having a first portion with a first diameter and a second portion with a second diameter;

a casing, comprising:

a first end cap having a first end and a second end, wherein the first end has a first threaded opening and the second end has a second threaded opening and the second end has a diameter matching the second diameter of the second portion of the upstream disk;

an elongated hollow member having a first portion, a main portion, and a second portion, wherein the first portion is thread to mate with the second end of the first end cap and has an internal diameter matching the second diameter of the second portion of the upstream disk and the second portion has a threaded portion to mate with a second end cap; and the second end cap having a centric opening that is threaded to mate with the second portion of the elongated hollow member;

wherein when the first end cap is secured to the elongated hollow member, the upstream disk is secured between the first end cap and the elongated hollow member, the second end cap is secured to the end second portion of the elongated hollow member, and the downstream disk is secured between the second end cap and the elongated hollow member;

wherein a first cavity is formed within the first end cap and the upstream disk and has a first volume, and a second cavity is formed in the elongated hollow member between the first and second diffuser tubes and has a second volume;

wherein the first diffuser tube has a larger interior diameter than the second diffuser tube;

wherein the plurality of openings in the upstream disk connect the first cavity with the second cavity and wherein the first cavity and the second cavity have distinct shapes;

wherein the centric opening of the upstream disk and the centric opening of the downstream disk are the same diameter.

2. The suppressor for firearms of claim 1, wherein the first end cap and the second end cap have a plurality of hollow indentations wherein the plurality of hollow indentations are sized to fit a spanner wrench.

3. The suppressor for firearms of claim 1, wherein the plurality of openings of the first hollow diffuser tube are at a predetermined angle.

4. The suppressor for firearms of claim 1, wherein the plurality of openings of the second hollow diffuser tube are at a predetermined angle.

5. The suppressor for firearms of claim 1, wherein the elongated hollow tube has a predetermined profile based on the positioning of the first and second hollow diffuser tubes within the elongated hollow tube.

6. The suppressor for firearms of claim 1, wherein the plurality of openings of the first diffuser tube is a predetermined pattern.

7. The suppressor for firearms of claim 1, wherein the plurality of openings of the second diffuser tube is a predetermined pattern.

8. The suppressor for firearms of claim 1, further comprising an adapter, wherein the adapter mates with the first end cap and a threaded barrel.

9. The suppressor for firearms of claim 1, wherein the centric opening of the upstream disk-and the centric opening of the downstream disk are substantially the same diameter.

10. The suppressor for firearms of claim 1, wherein the downstream disk has a profile to match a profile of the second end of the elongated hollow tube.

11. The suppressor for firearms of claim 1, wherein the upstream di-se disk has a profile to match a profile of the first end cap.

12. The suppressor for firearms of claim 1, wherein the first diffuser tube has a diameter matching the second diffuser tube.

13. A suppressor for firearms, comprising:

An upstream disk having a centric opening and a plurality of apertures positioned around the centric opening and a circular slot integrated into a downstream end of the upstream disk around the centric opening;

a first hollow diffuser tube having a first end and a second end and a plurality of openings distal to the first end, and the first end is secured into the circular slot of the upstream disk;

a second hollow diffuser tube having a first end and a second end and a plurality of openings distal to the first end and the second hollow diffuser is connected to the second end of the first hollow diffuser;

a downstream disk having a centric opening, and is connected to the second end of the second hollow diffuser;

a first end cap having a first end and a second end, wherein the first end has a first female threaded opening and the second end has a male threaded exterior to mate with a first end of an elongated hollow member;

the elongated hollow member having the first end and a second end, wherein the first end mates with the second end of the first end cap and the upstream disk is secured between the first end cap and the elongated hollow member; and a second end cap having a first and second opening, and mates with the second end of the elongated hollow member at the first opening, wherein the downstream disk is secured between the second end cap and the elongated hollow member;

wherein a first cavity is formed between the upstream disk and the first end cap and a second cavity is formed within the elongated member, and the first and second cavity are connected by the plurality of apertures of the upstream disk.

14. The suppressor for firearms of claim 13, wherein the second cavity is a first section and a second section, where the volume of the first section is less than the volume of the second section.

15. The suppressor for firearms of claim 13, wherein the plurality of openings of the first hollow diffuser are at a different angle than the plurality of openings of the second hollow diffuser.

16. The suppressor for firearms of claim 13, wherein the centric opening of the upstream disk and the downstream disk are beveled.

17. The suppressor for firearms of claim 13, wherein an interior diameter of the first hollow diffuser is greater than an interior diameter of the second hollow diffuser.

18. The suppressor for firearms of claim 13, wherein the securement of the upstream disk and the downstream disk align with the first end cap, the elongated hollow member and the second end cap align the upstream and downstream disk with the first opening of the first end cap and the second opening of the second end cap.

19. The suppressor for firearms of claim 13, wherein the centric opening of the upstream disk and the downstream disk are sized based on a bullet caliber.

* * * * *